US008968865B2

(12) United States Patent
Worsley et al.

(10) Patent No.: US 8,968,865 B2
(45) **Date of Patent: *Mar. 3, 2015**

(54) METHODS OF ELECTROPHORETIC DEPOSITION FOR FUNCTIONALLY GRADED POROUS NANOSTRUCTURES AND SYSTEMS THEREOF

(75) Inventors: Marcus A. Worsley, Hayward, CA (US); Theodore F. Baumann, Discovery Bay, CA (US); Joe H. Satcher, Patterson, CA (US); Tammy Y. Olson, Livermore, CA (US); Joshua D. Kuntz, Livermore, CA (US); Klint A. Rose, Alviso, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/171,323

(22) Filed: Jun. 28, 2011

(65) Prior Publication Data

US 2013/0004761 A1 Jan. 3, 2013

(51) Int. Cl.

| | |
|---|---|
| ***B32B 3/26*** | (2006.01) |
| ***B32B 5/14*** | (2006.01) |
| ***C25D 13/02*** | (2006.01) |
| ***C25D 15/00*** | (2006.01) |
| ***C25D 13/22*** | (2006.01) |
| ***C25D 1/00*** | (2006.01) |

(52) U.S. Cl.

CPC ..... *C25D 13/02* (2013.01); *C25D 15/00* (2013.01); *C25D 13/22* (2013.01); *C25D 1/006* (2013.01)

USPC ..... 428/322.7; 428/310.5; 428/327; 204/471; 204/509

(58) Field of Classification Search

USPC ..... 428/310.5, 322.7, 327; 521/76; 204/471, 509

See application file for complete search history.

(56) References Cited

U.S. PATENT DOCUMENTS

| | | | | |
|---|---|---|---|---|
| 6,531,100 | B1 * | 3/2003 | Ogata et al. | 422/177 |
| 8,440,229 | B2 * | 5/2013 | Trogler et al. | 424/489 |
| 2007/0047087 | A1 * | 3/2007 | Fukuda et al. | 359/582 |
| 2011/0212320 | A1 * | 9/2011 | Greenhill et al. | 428/313.3 |
| 2011/0250467 | A1 * | 10/2011 | Rose et al. | 428/610 |
| 2012/0269218 | A1 * | 10/2012 | Worsley et al. | 372/39 |

FOREIGN PATENT DOCUMENTS

WO WO 2010019609 A1 * 2/2010

* cited by examiner

*Primary Examiner* — Hai Vo

(74) *Attorney, Agent, or Firm* — Zilka Kotab

(57) ABSTRACT

In one embodiment, an aerogel includes a layer of shaped particles having a particle packing density gradient in a thickness direction of the layer, wherein the shaped particles are characterized by being formed in an electrophoretic deposition (EPD) process using an impurity. In another embodiment, a method for forming a functionally graded porous nanostructure includes adding particles of an impurity and a solution to an EPD chamber, applying a voltage difference across the two electrodes of the EPD chamber to create an electric field in the EPD chamber, and depositing the material onto surfaces of the particles of the impurity to form shaped particles of the material. Other functionally graded materials and methods are described according to more embodiments.

16 Claims, 8 Drawing Sheets

METHODS OF ELECTROPHORETIC DEPOSITION FOR FUNCTIONALLY GRADED POROUS NANOSTRUCTURES AND SYSTEMS THEREOF

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to functionality graded porous nanostructures, and more particularly, to using electrophoretic deposition to form functionality graded aerogels.

BACKGROUND

Aerogels are a fascinating class of high surface-area, mechanically-robust materials with a broad range of both commercial and fundamental scientific applications. Owing to its highly porous mass-fractal nanostructure, amorphous silica aerogel has been used as a capture agent in NASA's cometary-dust retrieval missions, to control disorder in $^3$He-superfluid phase transitions, in the fabrication of targets for laser inertial confinement fusion, in low-k microelectromechanical (MEMS) devices, and in Cherenkov nucleonic particle detectors.

In particular, amorphous carbon aerogel has received a considerable amount of attention in recent years owing to its low cost, electrical conductivity, mechanical strength, and thermal stability. Numerous applications have been explored for this material including water desalination, electrochemical supercapacitors, and thermal insulation.

The electrophoretic deposition (EPD) process utilizes electric fields to deposit charged nanoparticles from a solution onto a substrate. Earlier industrial use of the EPD process employed organic solvent solutions and therefore typically generated hazardous waste as a by-product of the process. In addition, the shapes, compositions, densities, and microstructures of materials formed through EPD processes have typically been difficult if not impossible to control, either separately or in combination with one another. Furthermore, templating has been used in EPD processes to control pore positioning and density; however, templating is restricted in that it is limited by the template material. Also, it is extremely difficult to form structures from more than one material. That is to say, typical EPD processes are limited in that they are only capable of forming planar, homogenous structures.

SUMMARY

In one embodiment, an aerogel includes a layer of shaped particles having a particle packing density gradient in a thickness direction of the layer, wherein the shaped particles are characterized by being formed in an EPD process using an impurity.

In another embodiment, a method for forming a functionally graded porous nanostructure includes adding particles of an impurity and a solution to an EPD chamber, wherein the solution comprises a material to be deposited onto a surface of the particles of the impurity, and wherein the EPD chamber comprises two electrodes at opposite ends of the EPD chamber, applying a voltage difference across the two electrodes of the EPD chamber to create an electric field in the EPD chamber, wherein the electric field causes the particles of the impurity to form a particle packing density gradient in a direction consistent with the electric field, and depositing the material onto surfaces of the particles of the impurity to form shaped particles of the material.

Other aspects and embodiments of the present invention will become apparent from the following detailed description, which, when taken in conjunction with the drawings, illustrate by way of example the principles of the invention.

DETAILED DESCRIPTION

Figure 1:
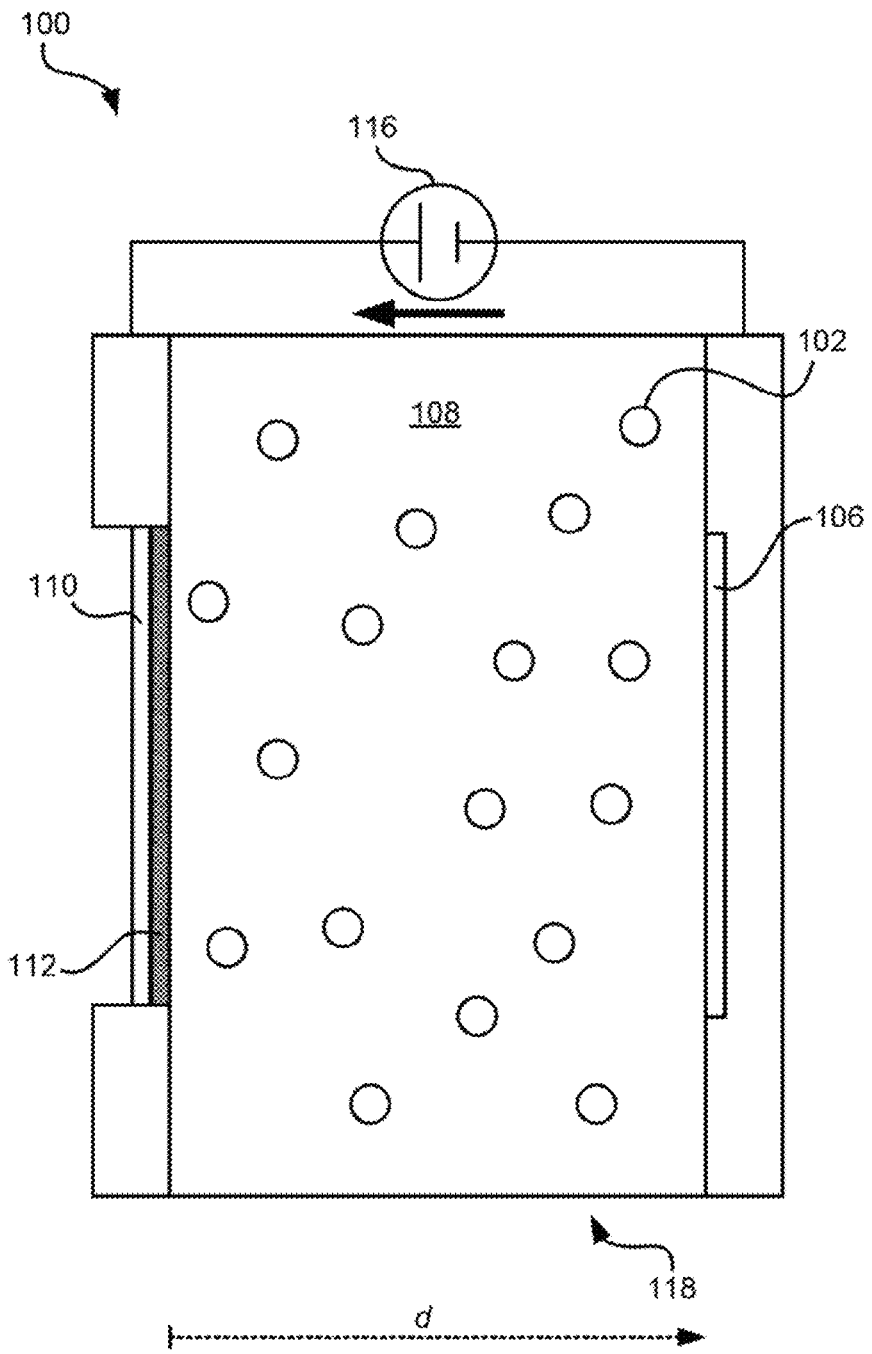
FIG. 1 is a simplified schematic diagram of an electrophoretic deposition (EPD) device, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an," and "the" include plural referents unless otherwise specified.

Functionally graded materials (FGM) fabricated with gradients in composition, microstructure, and/or density produce enhanced bulk properties, which typically correspond to a combination of the precursor material properties. For example, controlled composite layers of boron carbide and aluminum may produce lightweight ceramic materials that are both hard and ductile for improved armor. Current graded materials are primarily produced by coarse, layered processing techniques or melt-based approaches which are typically limited to abrupt gradients in composition along one axis only. The techniques described herein overcome these limitations using electrophoretic deposition (EPD) technology to fabricate functionally graded materials.

Typically, EPD has been used for forming coatings on surfaces using organic solvents. Recent nanomaterial work has demonstrated that EPD is capable of, at small length scales, being performed using aqueous (water-based) solutions. In addition, EPD may be performed using a wide variety of charged nanoparticles, such as oxides, metals, polymers, semiconductors, diamond, etc.

In one general embodiment, an aerogel includes a layer of shaped particles having a particle packing density gradient in a thickness direction of the layer, wherein the shaped particles are characterized by being formed in an EPD process using an impurity.

In another general embodiment, a method for forming a functionally graded porous nanostructure includes adding particles of an impurity and a solution to an EPD chamber, wherein the solution comprises a material to be deposited onto a surface of the particles of the impurity, and wherein the EPD chamber comprises two electrodes at opposite ends of the EPD chamber, applying a voltage difference across the two electrodes of the EPD chamber to create an electric field in the EPD chamber, wherein the electric field causes the particles of the impurity to form a particle packing density gradient in a direction consistent with the electric field, and depositing the material onto surfaces of the particles of the impurity to form shaped particles of the material.

For the sake of clarity and simplicity, for the remainder of this description, the porous nanostructure will be referred to as an aerogel. However, the descriptions and embodiments presented herein are not meant to be limited to only aerogels, as any suitable porous nanostructure or microstructure may be formed using the methods described herein.

By controlling certain characteristics of formation of structures in an EPD process, such as the precursor material composition (e.g., homogenous or heterogeneous nanoparticle solutions) and orientation (e.g., non-spherical nanoparticles), deposition rates (e.g., by controlling an electric field strength, using different solvents, particle concentrations, etc.), material layers and thicknesses (e.g., through use of an automated sample injection system and deposition time), and deposition patterns with each layer (e.g., via use of dynamic electrode patterning), intricate and complex structures may be formed using EPD processes that may include a plurality of densities, microstructures (e.g., ordered vs. random packing), and/or compositions, according to embodiments described herein.

Equation 1 sets out the basic system-level model for electrophoretic deposition, where $W_{film}$ is the mass of the deposition layer, μ is the electrophoretic mobility, E is the electric field, A is the area of the electrode substrate, C is the deposition particle mass concentration, and t is the deposition time.

$$W_{film}=\int_{t1}^{t2}\mu EACdt \qquad \text{Equation 1}$$

Combining these principles with dynamic patterning and sample delivery (which is described in more detail later), EPD may be employed to produce a diverse set of products with unique and/or difficult to obtain shapes, designs, and properties custom-fitted to any of a number of practical applications.

In one approach, EPD technology may be combined with organic sol-gelation, and carbonization if desired, to produce complex, functionally graded, porous nanostructures with properties custom fitted to a number of practical applications.

Referring now to the figures, as shown in FIG. 1, an EPD device 100 may include a first electrode 110 and a second electrode 106 positioned on either side of an EPD chamber 118, with a voltage difference 116 applied across the two electrodes 106, 110 that causes charged particles 102 in a solution 108 to move toward the first electrode 110 as indicated by the arrow. In some embodiments, a substrate 112 may be placed on a solution side of the first electrode 110 such that particles 102 may collect thereon. The EPD device 100, in some embodiments, may be used to attract particles 102 of an impurity toward the first electrode 110 or toward a conductive or non-conductive substrate 112 positioned on a side of the electrode 110 exposed to a solution 108 including the impurity 104 that will aid in formation of the aerogel.

By controlling certain characteristics of formation of structures in an EPD process, such as the precursor material composition (e.g., homogenous or heterogeneous nanoparticle solutions) and orientation (e.g., non-spherical nanoparticles), deposition rates (e.g., by controlling an electric field strength, using different solvents, particle concentration, etc.), material layers and thicknesses (e.g., through use of an automated sample injection system and deposition time), and deposition patterns with each layer (e.g., via use of dynamic electrode patterning), intricate and complex structures may be formed using EPD processes that may include a plurality of densities, microstructures (e.g., ordered vs. random packing), and/or compositions, according to embodiments described herein.

Figure 2B:
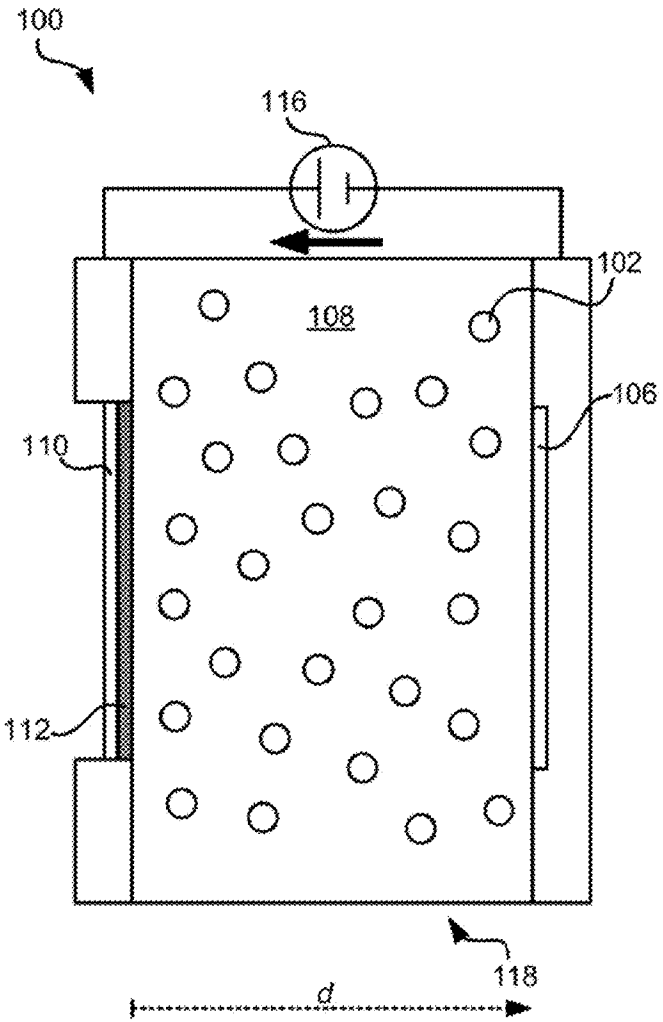
FIGS. 2A-2C show the formation of a functionally graded porous nanostructure through EPD, according to one embodiment.
Figure 2A:
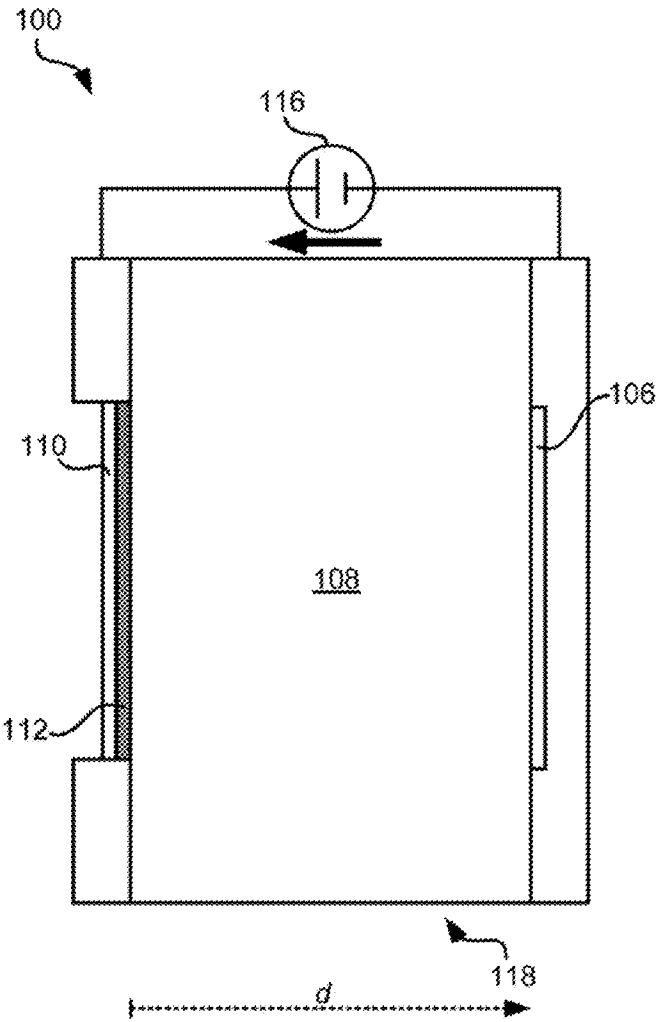

FIG. 2A shows an EPD device 100 setup with a solution 108 therein prior to addition of particles 102 of the impurity. The solution, in some embodiments, may include a material to be deposited onto a surface of the particles 102 of the impurity. The electrodes 106, 110 are positioned on opposite ends of the EPD chamber 118, in one approach. A substrate 112 may be positioned on a solution side of the electrode 110 to which charged particles are attracted, in some approaches.

As depicted in FIG. 2B, the solution 108 may comprise an organic sol-gel, or other monomer solution, and charged particles of an impurity 102 may serve as structural template materials for guiding functional gradation of the solution 108 after gelation. Structural template materials 102 may comprise long-chain polymers such as polystyrene, or any other polymer, which may have carboxylated or other surface functionalization for causing a desired effect. A surface functionalization for causing any desired effect as would be understood by one of skill in the art may be chosen, depending on the desired effect.

In more embodiments, the impurity may comprise metals, oxides, etc., as would be understood by one having ordinary skill in the art. While the solution 108 is characterized by a fluid state, charged impurity particles 102 migrate toward the first electrode 110, separating charged impurity particles 102 according to electrophoretic mobility and generating a gradient distribution of charged impurity particles 102 throughout the solution 108.

The gradient distribution may further be characterized by a decreasing concentration of impurity particles 102 with increasing distance d from the first electrode 110. After the gradient in particle packing density is formed, the gelation process takes place to form an aerogel.

Figure 2C:
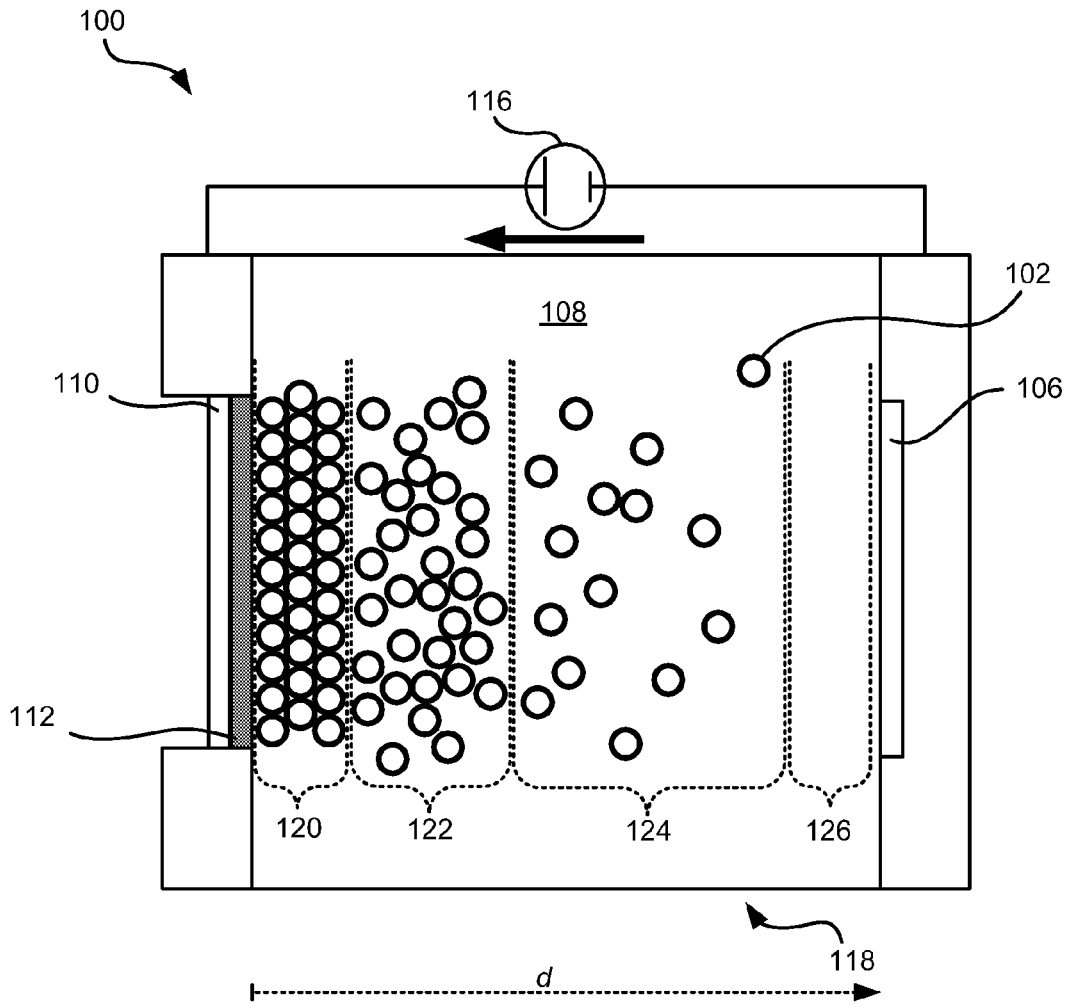

In some preferred embodiments, and as shown in FIG. 2C, the gradient distribution may exhibit one or more distribution zones. As shown in FIG. 2C, four or more zones may be formed, according to one embodiment: a first zone 120 located nearest the first electrode 110 and exhibiting tight, ordered packing of impurity particles 102, a second zone 122 exhibiting random packing of charged impurity particles 102, a third zone 124 nearer the second electrode 106 exhibiting charged impurity particles 102 solvated in the solution 108, and a fourth zone 126 substantially devoid of charged impurity particles 102. This gradient may be unidirectional or may be formed in multiple directions by applying multiple electric fields, in more embodiments.

According to one approach, as gelation takes place, the material in the solution 108 may be deposited upon surfaces of the impurity particles 102, shown as coating 126 in FIG. 2C. However, it is not required that the material be deposited in this manner, and may be formed in other ways, as would be understood by one of skill in the art upon reading the present descriptions.

In one embodiment, EPD may be used in conjunction with controlled electric field patterns to direct the composition of deposited material in an x-y plane parallel to a plane of deposition, including multilayer deposition of a single pattern as well as dynamically changing patterns as the particles build up in the z-dimension, perpendicular to the x-y plane.

Figure 3A:
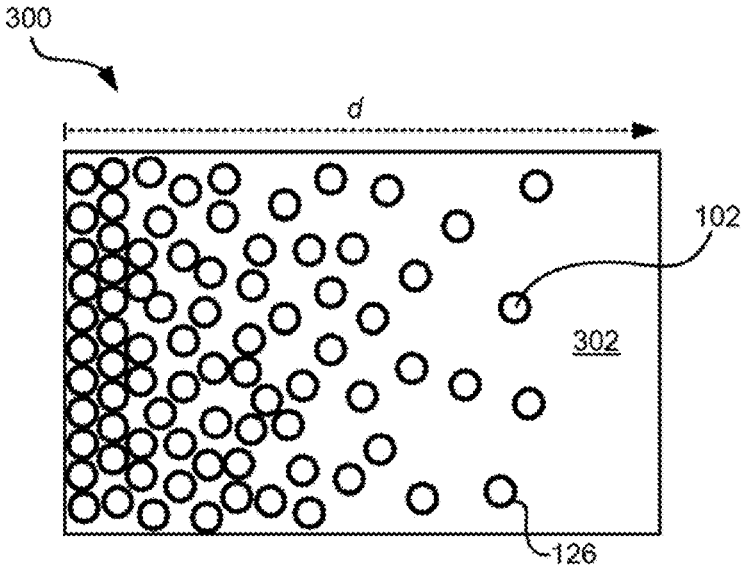
FIGS. 3A-3D show functionally graded porous nanostructures formed through EPD, according to various embodiments.

According to one embodiment, as shown in FIG. 3A, an aerogel 300 may comprise a layer 302 of shaped particles 126 having a particle packing density gradient 306 in a thickness direction (as indicated by d) of the layer 302. The shaped particles 126 are characterized by being formed in an EPD process using an impurity 102.

In one embodiment, the layer 302 may be substantially free of the impurity 102 and the shaped particles 126 may be hollow spheres, as shown in FIG. 3A.

Figure 3B:
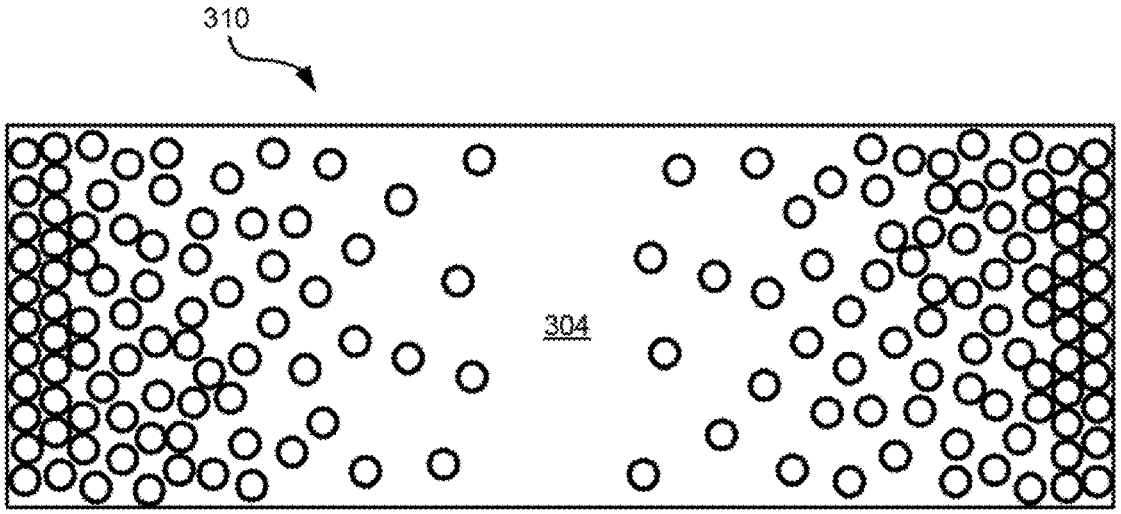
Figure 3C:
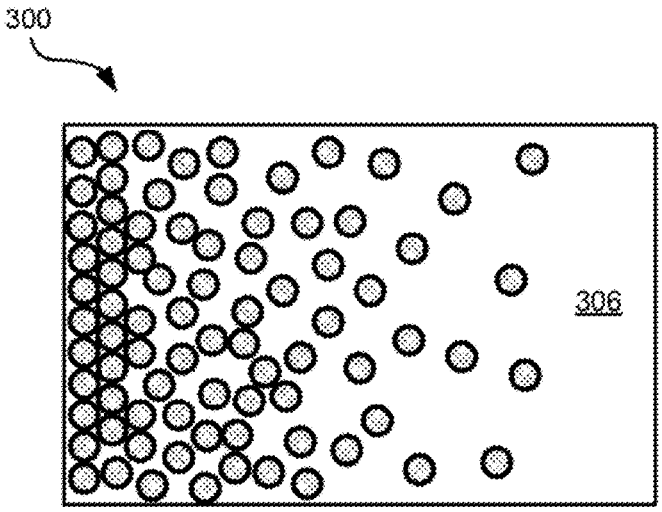

In another embodiment, as shown in FIG. 3C, the layer 306 may further comprise the impurity 102 having a particle packing density gradient corresponding to the particle packing density gradient of the shaped particles 126. In this or any other embodiment, the impurity 102 may comprise a metal or an oxide.

According to some embodiments, the shaped particles 126 may comprise carbon or any other material capable of forming an aerogel.

Figure 3D:
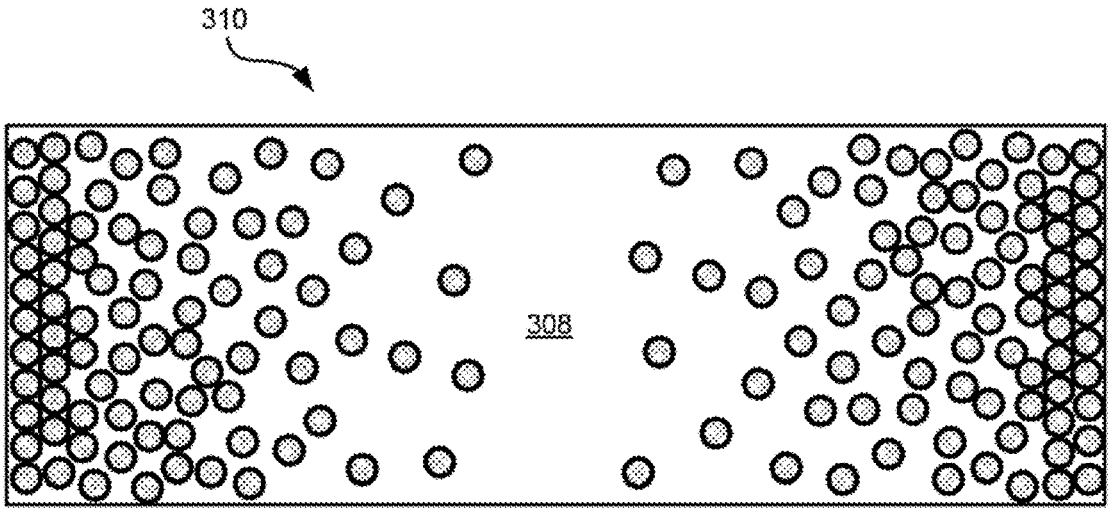

Now referring to FIGS. 3B and 3D, the aerogel 310, may be formed with more than one gradient in particle packing density, such as two gradients in opposite directions, as shown, or any other arrangement as would be understood by one of skill in the art upon reading the present descriptions.

As would be understood by one of skill in the art upon reading the present descriptions, one or more additional layers may be arranged above the layer 302-308 as shown in FIGS. 3A-3D, thereby forming a structure that may have complex layering and/or composition, with gradients possible in the thickness direction across all the layers.

In one embodiment, EPD may be used in conjunction with controlled electric field patterns to direct the composition of deposited material in a plane parallel to a plane of deposition, including multilayer deposition of a single pattern as well as dynamically changing patterns as the particles build up in the thickness direction, perpendicular to the plane. This technique enables, for example, transparent ceramic optics with a controlled, smooth, concentration of dopant material.

Furthermore, along a plane of deposition perpendicular to the plane, the aerogel may exhibit a functional gradient as described above and with reference to FIGS. 3A-3D. Generally, the functional gradient may be characterized according to decreasing concentration of structural template nanoparticles 102 with increasing distance d from the first electrode 110.

In applications where structural template impurity particles 102 are removed during carbonization, or where structural template impurity particles 102 exhibit low density relative to the solution 108, the resulting final aerogel may therefore exhibit at least a particle packing density gradient characterized by a density inversely proportional to a distance d from the first electrode 110.

Conversely, where structural template impurity particles 102 exhibit higher density than the solution 108, and are not removed during carbonization, the resulting aerogel exhibits at least a particle packing density gradient characterized by a density directly proportional to distance d from the first electrode 110.

Figure 4:
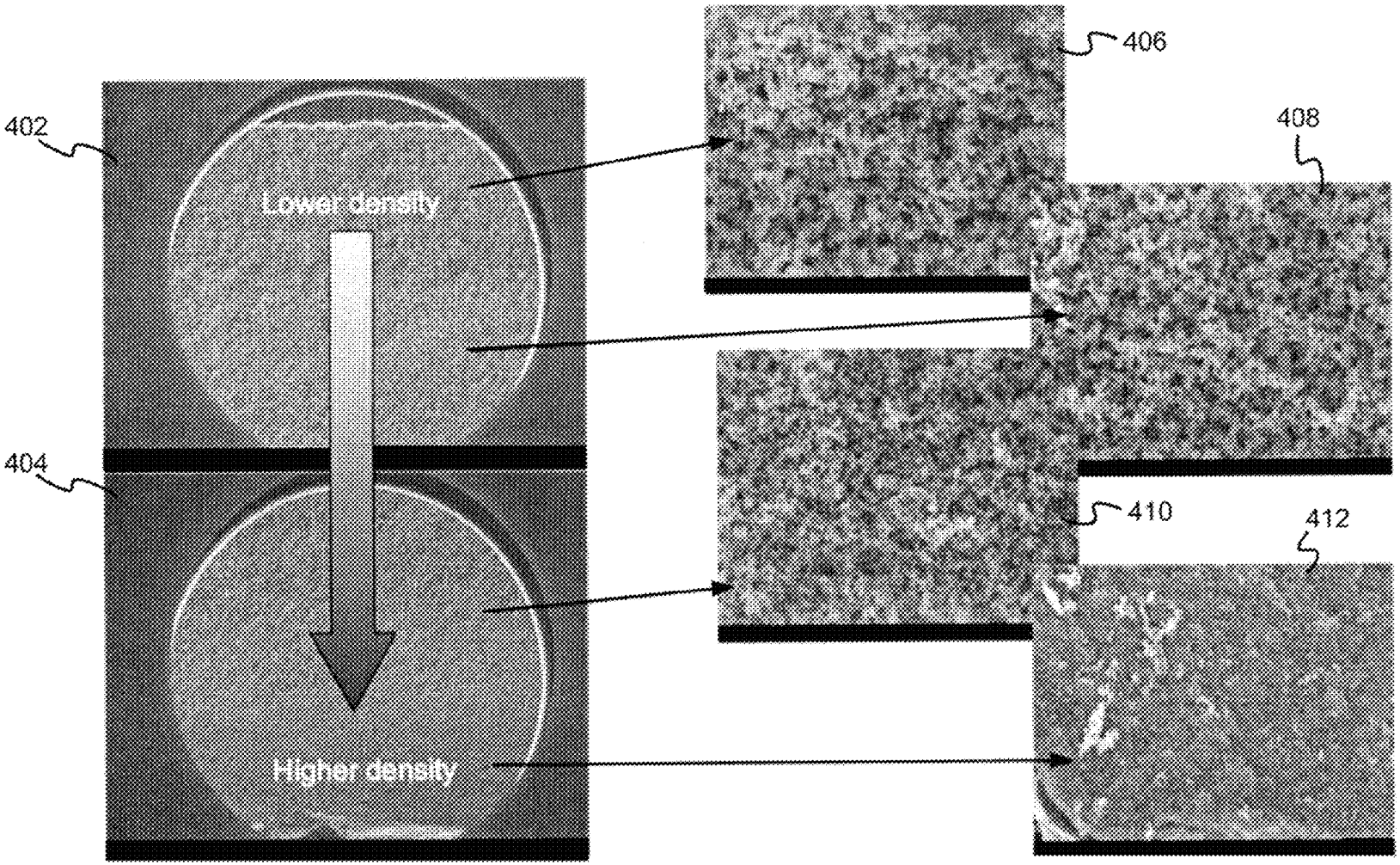
FIG. 4 is a collection of SEM images showing higher and lower particle packing densities of a functionally graded porous nanostructure, according to one embodiment.

Referring now to FIG. 4, a scanning electron microscope (SEM) image of an aerogel 402, 404 after carbonization is shown according to one embodiment. The images exhibit a particle packing density gradient characterized by a density inversely proportional to a distance from the first electrode (located at the bottom of each aerogel shown in FIG. 4). The first blow-up image 406 shows loosely packed particles, the second blow-up image 408 shows slightly more tightly packed particles, the third blow-up image 410 shows even more tightly packed particles, and the fourth blow-up image 412 shows very closely packed particles. A gradual particle packing density gradient such as that shown in FIG. 4 may be formed through the techniques and methods described herein, according to various embodiments.

Figure 5:
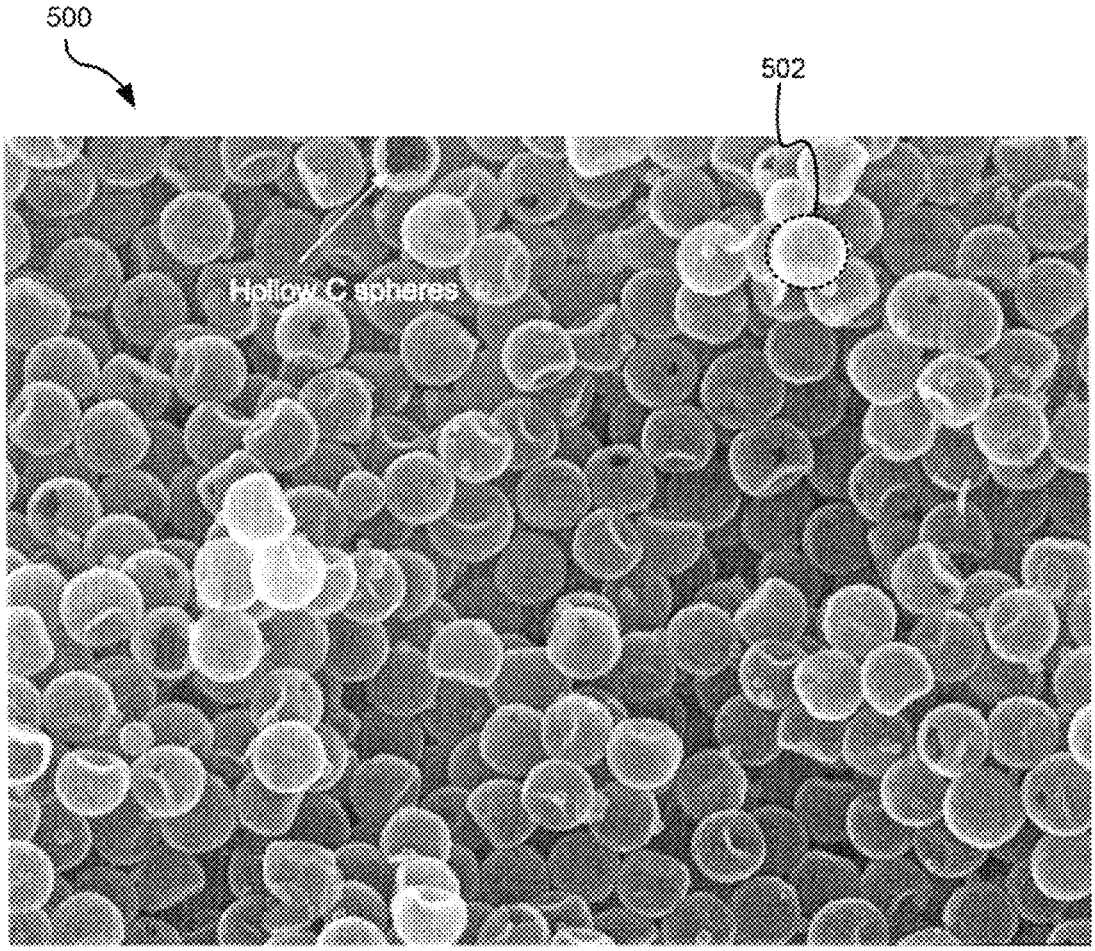
FIG. 5 is a SEM image of hollow spheres in a functionally graded porous nanostructure, according to one embodiment.

Referring now to FIG. 5, a SEM image of an aerogel 500 after carbonization that exhibits a characteristic of being formed through an EPD process is shown according to one embodiment. As can be seen in FIG. 5, hollow spherical particles 502 are shown. In this image, the hollow spherical particles 502 represent a spatial void where, according to one embodiment, charged impurity particles settled during EPD and were subsequently removed during carbonization. As a result, a low-density gap remains in each of the spatial voids distributed within the aerogel, surrounded by deposited material.

Figure 6:
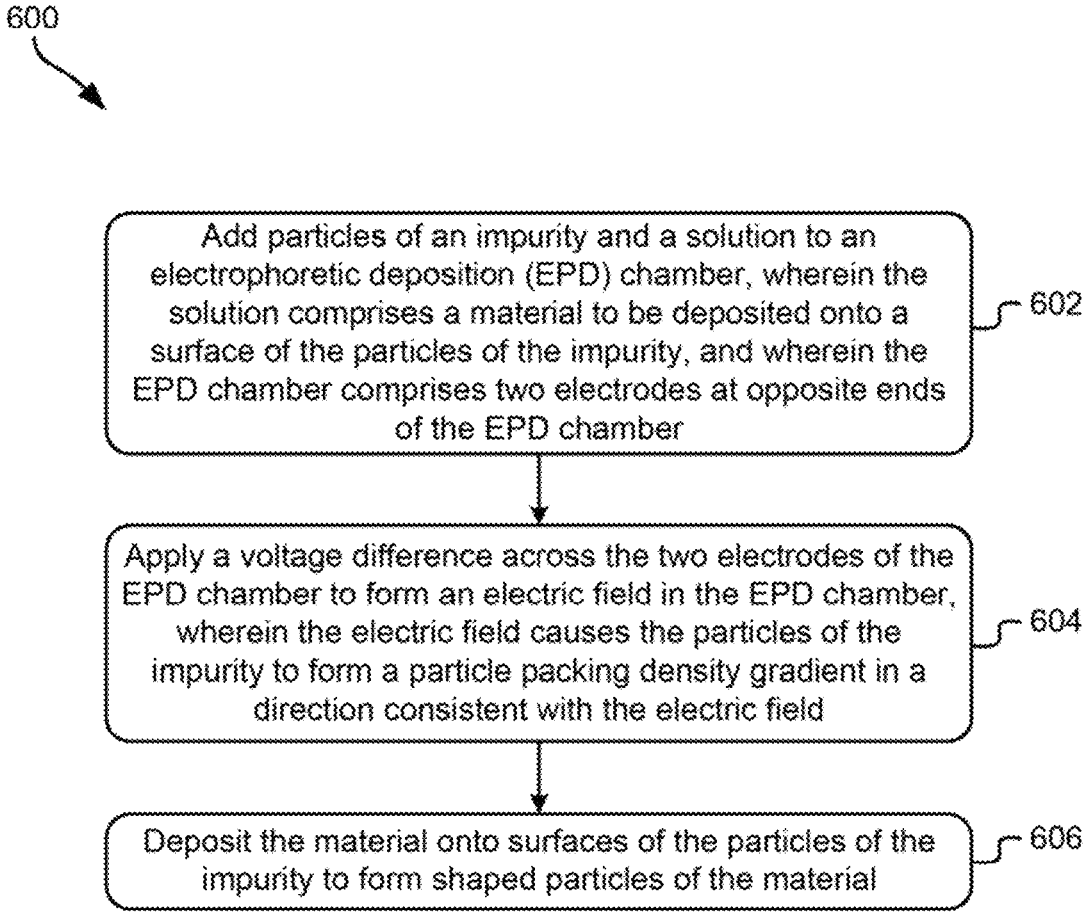
FIG. 6 is a flow diagram of a method for forming a functionally graded porous nanostructure through EPD, according to one embodiment.

Now referring to FIG. 6, a method 600 for forming a functionally graded porous nanostructure is shown according to one embodiment. The method 600 may be carried out in any desired environment, including those shown in FIGS. 1-5, among others.

In operation 602, particles of an impurity and a solution are added to an EPD chamber, wherein the solution comprises a material to be deposited onto a surface of the particles of the impurity, and wherein the EPD chamber comprises two electrodes at opposite ends of the EPD chamber. The solution and the impurity may be mixed prior to being added, mixed when added, added separately, or in any other combination.

In operation 604, a voltage difference is applied across the two electrodes of the EPD chamber to form an electric field in the EPD chamber, wherein the electric field causes the particles of the impurity to form a particle packing density gradient in a direction consistent with the electric field.

In operation 606, the material is deposited onto surfaces of the particles of the impurity to form shaped particles of the material.

In some embodiments, the method 600 may further comprise allowing the shaped particles of the material, the impurity, and the solution to gel, drying the shaped particles of the material and the impurity to remove remaining solution, and pyrolizing the shaped particles of the material to form a functionally graded porous nanostructure.

In a further embodiment, the shaped particles of the material may be pyrolized to substantially remove the impurity resulting in hollow shaped particles of the material.

Additionally, the impurity may comprise a polymer with carboxylated surface functionalization or some other surface functionalization for causing a desired effect and the shaped particles may comprise hollow spheres. In one embodiment, the shaped particles may be spherical and/or hollow spheres. In addition, the material may comprise carbon or any other suitable material. A surface functionalization for causing any desired effect as would be understood by one of skill in the art may be chosen, depending on the desired effect.

According to one example, EPD was used, to form a gradient in polystyrene particle concentration in an organic sol before gelation of the organic sol. The gradient is preserved during gelation of the organic sol and subsequent carbonization to form a graded density carbon aerogel. The particle concentration gradient concurrently forms a density gradient in the carbon aerogel as the polystyrene is removed, leaving a gradient in void space as well.

In this example, an organic sol was prepared by combining 7.5 g water, 6.125 g resorcinol, 9 g formaldehyde, and 220 μL acetic acid. 5 mL of 10 vol % 920 nm polystyrene particles with carboxylated surface functionalization was added to the solution to form a suspension, which was placed in an EPD chamber. An electric field of 10 V/cm was applied to the suspension for 15 minutes. The entire EPD assembly was sealed and incubated at 85° C. overnight to gel. After gelation, the sample was washed in acetone and dried in air at room temperature. Carbonization of the sample was performed at 1050° C. in nitrogen. The final product was 20 mm×20 mm×3.6 mm (L×W×H) and had an estimated density greater than 243 mg/cc.

SEM analysis of this sample shows a gradient density aerogel having hollow carbon spheres with a range of packing densities depending upon film depth in a deposition (film thickness) direction. Transition from low to high density is relatively gradual compared to coarse deposition techniques described earlier.

As the embodiments described herein aptly demonstrate, the EPD methods and structures formed through the EPD methods disclosed herein, according to various embodiments, may be used for any number of novel materials and structures.

According to some embodiments, the methods and structures described herein may be used for hydrogen or other gas storage (such as for fuel cell technology), targets for capturing and analyzing thrown particles, capacitors, sensors, catalysis, filtering, water purification, and batteries, among other uses.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A product, comprising:

a carbon aerogel including a plurality of shaped particles therein, wherein the plurality of shaped particles have a particle packing density gradient in a thickness direction of the carbon aerogel, the thickness direction of the carbon aerogel being perpendicular to a plane of deposition of the shaped particles, the particle packing density being a measure of a degree of how tightly packed the shaped particles are with respect to each other in the carbon aerogel, wherein a higher particle packing density corresponds to more tightly packed particles than a lower particle packing density, and wherein the shaped particles are characterized by being formed in an electrophoretic deposition (EPD) process using one or more impurities, wherein the shaped particles are hollow spheres consisting of carbon.

2. The product as recited in claim 1, wherein the carbon aerogel is substantially free of the impurities.

3. The product as recited in claim 1, wherein at least one of the impurities comprises a polymer with carboxylated surface functionalization.

4. The product as recited in claim 1, wherein at least one of the impurities comprises a polymer with a surface functionalization for causing a desired effect.

5. The product as recited in claim 1, wherein the particle packing density gradient is formed in multiple directions, and is characterized by being formed in the EPD process by applying multiple electric fields.

6. The product as recited in claim 1, wherein the plurality of shaped particles have a zone of ordered packing of the shaped particles and a zone of random packing of the shaped particles.

7. The product as recited in claim 1, wherein the particle packing density gradient comprises a shaped particle concentration gradient.

8. The product as recited in claim 1, wherein the shaped particles in the carbon aerogel have about a same size.

9. A product, comprising:

a carbon aerogel including a plurality of shaped particles therein, wherein the plurality of shaped particles have a particle packing density gradient in a thickness direction of the carbon aerogel, the particle packing density being a measure of a degree of how tightly packed the shaped particles are with respect to each other in the carbon aerogel, wherein a higher particle packing density corresponds to more tightly packed particles than a lower particle packing density, wherein the thickness direction of the carbon aerogel is perpendicular to a plane of deposition of the shaped particles, wherein the shaped particles are characterized by being formed in an electrophoretic deposition (EPD) process using an impurity, wherein the carbon aerogel is substantially free of the impurity and the shaped particles are hollow spheres consisting of carbon, and wherein a size of the shaped particles in the carbon aerogel is substantially equal.

10. A product, comprising:

a carbon aerogel including a first plurality of shaped particles in a first portion of the carbon aerogel, wherein the first plurality of shaped particles have a first particle packing density gradient in a thickness direction of the first portion of the carbon aerogel, the first particle packing density being a measure of a degree of how tightly packed the shaped particles are with respect to each other in the first portion of the carbon aerogel, wherein a higher particle packing density corresponds to more tightly packed particles than a lower particle packing density, wherein the thickness direction of the first portion of the carbon aerogel is perpendicular to a plane of deposition of the first plurality of shaped particles, wherein the first plurality of shaped particles in the first portion of the carbon aerogel are hollow spheres consisting of carbon.

11. The product as recited in claim 10, wherein the aerogel further comprises a second plurality of shaped particles in a second portion of the carbon aerogel, wherein the second plurality of shaped particles has a second particle packing density gradient in a thickness direction of the second portion of the carbon aerogel, the thickness direction of the second portion of the carbon aerogel being oriented perpendicular to a plane of deposition of the second plurality of shaped particles.

12. The product as recited in claim 11, wherein the second plurality of shaped particles in the second portion of the carbon aerogel are hollow spheres consisting of carbon aerogel.

13. The product as recited in claim 11, wherein a size of the second plurality of shaped particles in the second portion of the carbon aerogel is substantially equal, wherein the second particle packing density corresponds to a concentration of the second plurality of shaped particles in the second portion of the carbon aerogel.

14. The product as recited in claim 11, wherein the second particle packing density gradient is different from the first particle packing density.

15. The product as recited in claim 14, wherein the second particle packing density is a reverse of the first particle packing density.

16. The product as recited in claim 10, wherein the first particle packing density corresponds to a concentration of the first plurality of shaped particles in the first portion of the carbon aerogel.

* * * * *